United States Patent [19]

Smit

[11] Patent Number: 4,992,057

[45] Date of Patent: Feb. 12, 1991

[54] DEVICE COMPRISING A CARRIER WITH HOLES FOR RECEIVING PINS

[75] Inventor: Hermanus Smit, Eindhoven, Netherlands

[73] Assignee: U.S. Philips Corporation, New York, N.Y.

[21] Appl. No.: 499,924

[22] Filed: Mar. 26, 1990

[30] Foreign Application Priority Data

Apr. 13, 1989 [NL] Netherlands ..... 8900920

[51] Int. Cl.[5] ..... H01R 9/09

[52] U.S. Cl. ..... 439/83; 439/876

[58] Field of Search ..... 439/65, 78, 83, 84, 439/751, 873, 880, 444, 733, 741, 874, 875, 876

[56] References Cited

U.S. PATENT DOCUMENTS 4,627,162 12/1986 Holt ..... 439/78 X

FOREIGN PATENT DOCUMENTS 0931657 7/1963 United Kingdom ..... 439/751

*Primary Examiner*—Eugene F. Desmond
*Assistant Examiner*—J. R. Daulton
*Attorney, Agent, or Firm*—Brian J. Wieghaus

[57] ABSTRACT

The electrically insulating carrier comprises at least one through-hole which extends from a first face to an oppositely situated second face of the carrier and which serves to receive an electrically conductive pin having a mainly rectangular cross-section. The hole comprises three sections which are consecutively disposed in its longitudinal direction, the first section opening into the first face of the carrier and having a cross-section whose dimensions are so large that, after insertion, the pin does not contact the wall of the first section in any location. The second section has an at least partly circular cross-section whose diameter is so much smaller than the diagonal of the cross-section of the pin that the pin is retained by friction between the pin and the wall of this section. The third section has a cross-section whose largest dimension at the most equals the smallest dimension of the cross-section of the pin. When the portion of the pin which projects from the second face of the carrier comes into contact with solder flux, the flux cannot pass through the third section which is sealed substantially completely by the pin.

2 Claims, 1 Drawing Sheet

DEVICE COMPRISING A CARRIER WITH HOLES FOR RECEIVING PINS

BACKGROUND OF THE INVENTION

The invention relates to a device comprising an electrically insulating carrier with at least one through-hole which extends from a first face to a second face of the carrier which is situated opposite said first face and which hole serves to receive an electrically conductive pin which has a mainly rectangular cross-section. The first end of said pin projects from the first face while its second end projects from the second face after insertion of the pin into the carrier. The hole comprises at least two sections which are consecutively disposed in its longitudinal direction, the first section opening into the first face of the carrier and having a cross-section whose dimensions are so large that, after insertion, the pin does not contact the wall of the first section in any location, the second section having an at least partly circular cross-section whose diameter is so much smaller than the diagonal of the cross-section of the pin that the pin can be pressed into the second section with some force, thus producing the friction required for retaining the pin between the corner portions of the pin and the parts of the wall of the second section which contact said corner portions.

The device may be, for example a connector where the carrier constitutes the connector housing and the pins constitute the contact members of the connector.

U.S. Pat. No. 3,737,998 discloses a device of this kind where the carrier is formed by a molded board. Therein the first section of the hole serves to guide the pin to the second section during its insertion.

In some cases it is desirable that the second ends of the pins, projecting from the second face of the carrier, are connected to other electrical conductors, for example, conductor tracks on a printed circuit board, by means of a soldered joint. For such a soldered joint use in made of a flux which tends to migrate, via the clearance between the wall of the hole and the surface of the pin, to the first face on the other side of the carrier. Flux residue may have an adverse effect on the poroperties of the pins other components present on the first face.

U.S. Pat. No. 4,646,204 discloses a printed circuit board with holes for receiving pins for cooperation with a connector for establishing connections between conductor tracks on the board and a further device which is not accommodated on the board. The second ends of the pins, projecting from the second face of the board, are connected to conductor tracks on the second face by way of a soldered joint. The latter U.S. Patent Specification proposes to counteract the flux migration as much as possible by minimising the clearance between the wall of the hole and the surface of the pin. However, it has been found that in some cases a very narrow duct is thus formed, so that the flux can very readily migrate from the second face to the first face due to capillary effects. On the other hand, it is not very well possible to impart a rectangular cross-section to the holes in which the pins fit exactly in order to make the clearances between the wall of the holes and the surface of the pins completely flux-tight; this is because such a step readily leads to cracking of the board material as stated in the cited Patent Specification.

SUMMARY OF THE INVENTION

It is an object of the invention to provide a device of the kind set forth in which migration of flux from the second face to the first face is effectively prevented in a manner which is not detrimental to the carrier. To achieve this, device in accordance with the invention is characterized in that the hole comprises a third section which extends between the second section and the second face of the carrier, which third section has a cross-section whose largest dimension at the most equals the smallest dimension of the cross-section of the pin.

Along its entire circumference, the surface of the pin contacts the wall of the third section of the hole which is distorted during insertion of the pin. Thus, this section constitutes a substantially flux-tight barrier. Because the third section extends over only a small part of the thickness of the carrier, the risk of cracking upon insertion of the pin is precluded.

Because of this small length, however, small leaks in the sealing of the third section be completely precluded. In the event of such leaks, flux penetrating there through could be transported to the first section by a capillary effect in the second section. Because a comparatively large clearance exists around the pin in the first section of the hole, no capillary effects can occur therein. Therefore, this clearance can be used to collect the very small amount. of flux possibly penetrating via a small leak in the third section and transported further by a capillary effect in the second section, the flux thus staying remote from the first face.

BRIEF DESCRIPTION OF THE DRAWINGS

The invention will be described in detail hereinafter with reference to the drawing. Therein.

DESCRIPTION OF THE PREFERRED EMBODIMENT

Figure 1:
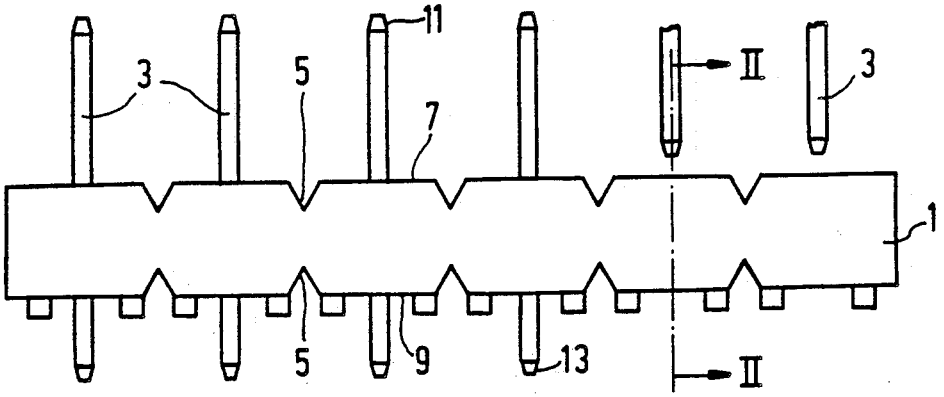
FIG. 1 is a side elevation of an embodiment of the device in accordance with the invention.

FIG. 1 is a side elevation of a contact strip, comprising a carrier 1 which is made of an electrically insulating plastics, and a number of electrically conductive, rectangular pins 3. The carrier 1 of the present embodiment is shaped as a rod having a rectangular cross-section. Notches 5 which extend transversely of the longitudianl direction of the rod subdivide the rod into a number of carrier sections, each of which comprises a through-hole (not shown in FIG. 1) which serve to receive one of the pins 3. The hole extends from a first face 7 of the carrier 1 (the upper face in FIG. 1) as far as an oppositely situated second face 9 (the lower face). In FIG. 1 a number of pins 3 have already been inserted into the holes, the other pins (at the right in the Figure) being ready for insertion into the holes in the direction downwards from the upper face 7. The already inserted pins 3 show that a first end 11 of each pin projects from the first face 7 and that a second end 13 projects from the second face 9.

Figure 2:
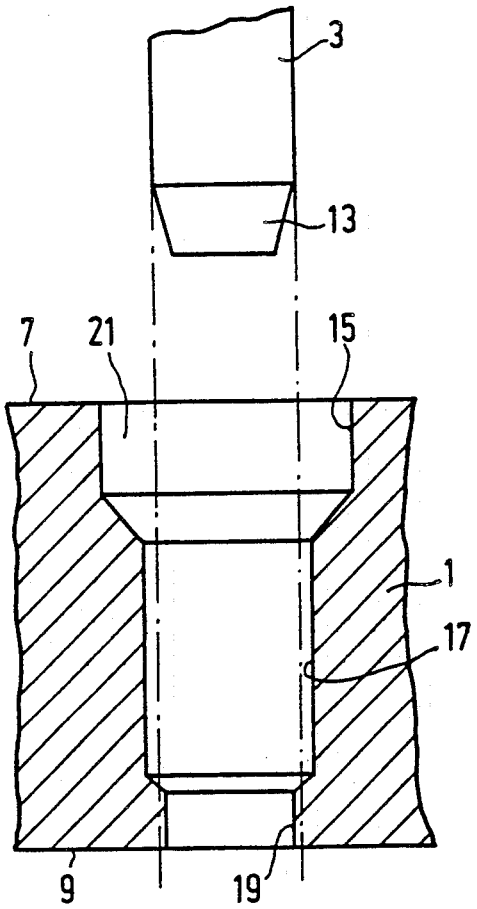
FIG. 2 is a cross-sectional view at an increased scale of the device shown in FIG. 1.
Figure 3:
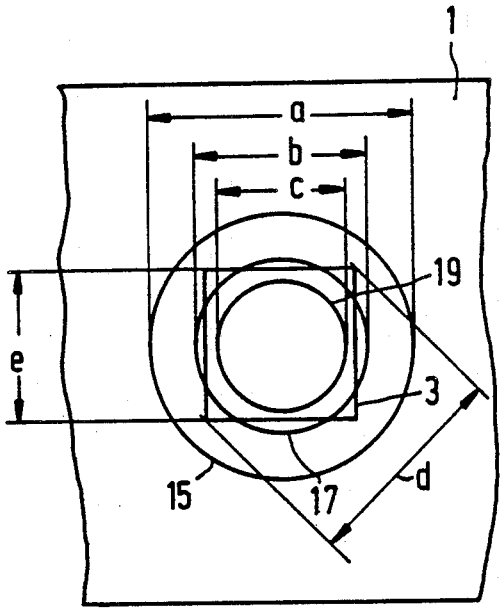
FIG. 3 is a plan view at an increased scale of the device shown in FIG. 1.

FIG. 2 shows, at an increased, scale, a cross-sectional view taken along the line II—II in FIG. 1. FIG. 2 shows that the through-hole comprises three sections 15, 17 and 19 which are consecutively disposed in the longitudinal direction of the hole. The first section 15 opens into the first face 7 of the carrier 1 and has a circular cross-sections whose diameter is greater than the length of the diagonal of the cross-section of the pin 3, which is square. In the plan view of FIG. 3 the diameter of the first section 15 is denoted by the reference a and the length of said diagonal is denoted by the reference d. The side of the square constituting the cross-section of the pin 3 is denoted by the reference e. The FIG. 2 and 3 clearly show that the pin 3 does not contact the wall of the first section 15 in any location, so that a comparatively large clearance 21 exists around the pin.

The second section 17 also has a circular cross-section having a diameter b (see FIG. 3) which is smaller than the diagonal d of the cross-section of the pin 3 and larger than the side e of said cross-section. Consequently, the pin can be pressed into the second section 17 with some force, the corner portions of the pin then slightly deflecting the wall of the section. The friction thus produced between then pin 3 and the wall of the second section 17 retains the pin in the hole.

Between the second section 17 and the second face 9 of the carrier 1 of the present embodiment there is formed a third section 19 which also has a circular cross-section with a diameter c (see FIG. 3) which is slightly smaller than the side e of the cross-section of the pin 3. The force required for pressing the pin 3 into the third section 19 is greater than the force required for pressing the pin into the second section 17. The pressing of the pin 3 into the second and the third sections 17 and 19 is facilitated in that the second end 13 of the pin is shaped as a truncated pyramid or cone. Upon insertion of the pin 3 into the third section 19, the wall of this section is pushed aside along the entire circumference, so that the pin seals the third section substantially completely. In order to prevent cracking of the material of the carrier 1 during this operation, the length of the third section is chosen to be comparatively small.

After insertion of all pins 3 into the carrier 1, the contact strip thus formed can be mounted as a connector portion on a printed circuit board (not shown) by inserting the second ends 13 of the pins through holes in the board, followed by soldering to the wiring. This operation utilises flux which could migrate, via the surface of the pins 3, to the first face 7 of the carrier 1 and to the part of the pins projecting from this face. Such migration, however, is prevented by the described shape and dimensions of the hole 15, 17, 19. The pin 3 substantially seals the third section 19, so that the flux can in principle not pass this section. However, inter alia because of the small length of the third section 19 it may occur that sealing is not perfect, so that small leaks may arise. The flux penetrating via such leaks could be transported upwards due to the capillary effect between the surface of the pin 3 and the wall of the second section 17, and ultimately reach the first section 15. However, no capillary effects will occur in the comparatively large clearance 21 between the pin 3 and the wall of the first section, so that flux having passed the second section will be collected in this clearance and remain below the first face 7. Consequently, this flux cannot cause corrosion of the surface of the portion of the pin 3 which projects from the first face 7 and which is intended to cooperate, for example with contact springs of a second connector portion (not shown).

Favourable results have been obtained for a contact strip having the described onfiguration and the following dimensions:

$a=1.1$ mm $b=0.75$ mm $c=0.58$ mm $e=0.63$ mm(so $d=e\sqrt{2}=0.89$ mm).

The thickness of the carrier 1 (the distance between the first face 7 and the second face 9) amounted to 2 mm, the length of the first section 15 amounted to 0.4 mm, and the length of the third section 19 amounted to 0.3 mm.

It is alternatively possible to use geometries and dimensions other that those described. Sections having a circular cross-section are to be preferred in many cases, because they can be readily realised, for example by drilling, but other geometries of the cross-section can also be used. For example, the second section 19 may have partly linear walls as described in the cited U.S. Pat. No. 4,646,204. The first section 15 and the third section 19 may also have a square cross-section, in which case the position of the pin 3 should correspond to the orientation of these squares upon insertion. The pin 3 need not be square. Pins having a rectangular cross-section are also suitable. The carrier 1 may alternatively be shaped other than a bar as described. For example, it may be a plate on which there is provided a wiring pattern as described in U.S. Pat. No. 4,646,204.

I claim:

1. A device comprising an electrically insulating carrier, said carrier comprising a first face, a second face opposite said first face, and a circumferential wall extending from said first face to said second face and defining a through-hole for receiving an electrically conductive pin having a mainly rectangular cross-section, a first end of said pin projecting from said first face and a second pin end projecting from said second face after insertion of said pin into the carrier, the hole comprising at least two sections which are consecutively disposed in its longitudinal direction, the first section opening into said first carrier face and having a cross-section large enough such that, after insertion, the pin does not contact the wall of the first section in any location, the second section having an at least partly circular cross-section whose diameter is so much smaller than the diagonal of the cross-section of the pin that the pin can be pressed onto the second section with some force, thus producing friction for retaining the pin between corner portions of the pin and parts of the wall of the second section which contact said corner portions, characterized in that: said circumferential wall defines a third hole section which extends between the second section and said second carrier face and has a cross-section whose largest dimension at the most equals the smallest dimension of the cross-section of the pin.

2. A device as claimed in claim 1, characterized in that said pin has a cross-section having the shape of a square with sides (e) of approximately 0.63 mm, the first, the second and the third section of the hole having a circular cross-section with diameters (a,b,c) amounting to approximately 1.1 mm, 0.75 mm and 0.58 mm, respectively.

* * * * *